US010865602B1

(12) United States Patent
Varshavsky

(10) Patent No.: US 10,865,602 B1
(45) Date of Patent: Dec. 15, 2020

(54) LADDER STABILIZATION SUPPORT ASSEMBLY

(71) Applicant: Jacob Varshavsky, Pacifica, CA (US)

(72) Inventor: Jacob Varshavsky, Pacifica, CA (US)

( * ) Notice: Subject to any disclaimer, the term of this patent is extended or adjusted under 35 U.S.C. 154(b) by 0 days.

(21) Appl. No.: 16/543,555

(22) Filed: Aug. 17, 2019

(51) Int. Cl.
*E06C 7/44* (2006.01)
*E06C 7/42* (2006.01)
*E06C 1/12* (2006.01)

(52) U.S. Cl.
CPC ..... *E06C 7/423* (2013.01); *E06C 7/44* (2013.01); *E06C 1/12* (2013.01)

(58) Field of Classification Search
CPC ..... E06C 7/423; E06C 7/44
See application file for complete search history.

(56) References Cited

U.S. PATENT DOCUMENTS 3,576,309 A * 4/1971 Zawacki ..... F16K 5/0689 251/174
3,878,917 A * 4/1975 McBride ..... E06C 1/20 182/172
4,723,629 A 2/1988 Vanden Hoek et al.
4,872,529 A * 10/1989 Viets ..... E06C 1/38 182/172
4,949,809 A 8/1990 Levi et al.
5,423,397 A 1/1995 Boughner
5,868,222 A 2/1999 Charbonneau
6,167,989 B1 1/2001 Jung
6,533,071 B1 3/2003 Smith
6,672,427 B1 * 1/2004 Sheffield ..... E06C 1/22 182/165
6,910,666 B2 * 6/2005 Burr ..... A47B 91/066 248/188.2
7,163,084 B1 * 1/2007 Blehm ..... E06C 7/423 182/172
7,891,618 B2 * 2/2011 Carnevali ..... F16M 11/2078 248/228.6
9,033,104 B1 5/2015 Calloway
9,187,954 B1 11/2015 Parsons
9,482,053 B2 11/2016 Polzen
(Continued)

FOREIGN PATENT DOCUMENTS

CA 2233713 A1 * 10/1999 ..... E06C 7/44
FR 1467900 A * 2/1967 ..... E06C 7/423

*Primary Examiner* — Alvin C Chin-Shue

(57) ABSTRACT

A ladder stabilization support assembly for lateral and vertical stabilization support to ladders in general and long span extension ladders in particular preventing the ladders from lateral movement such as tipping, overturning or slipping off the supporting grounds. The assembly is built to take advantage of a light-weight t-slotted aluminum profile and comprises two telescopic support legs pivotally mounted on opposite sides of a ladder to effectively support and level the ladder on any uneven supporting grounds. An adjustable sliding mechanism provides for a smooth, low tolerance and wobble-free telescopic sliding function with numerous length adjustments positions. A pivot joint provides for endless number of pivotal and swivel adjustment positions. The assembly can quickly and easily be mounted onto the ladder, remain permanently attached to the ladder or be taken off the ladder when not in use. The assembly also allows extension ladders to operate in a self-supporting stand-alone mode.

6 Claims, 7 Drawing Sheets

(56) References Cited

U.S. PATENT DOCUMENTS

| | | | | |
|---|---|---|---|---|
| 2005/0058258 | A1* | 3/2005 | Martti | A61B 6/145 378/197 |
| 2011/0017549 | A1* | 1/2011 | Lietz | E06C 1/06 182/172 |
| 2012/0168253 | A1* | 7/2012 | McMurray | E06C 1/22 182/172 |
| 2019/0390518 | A1* | 12/2019 | Yoo | E06C 7/46 |
| 2020/0149348 | A1* | 5/2020 | Khwaja | E06C 7/423 |

* cited by examiner

LADDER STABILIZATION SUPPORT ASSEMBLY

CROSS-REFERENCE TO RELATED APPLICATIONS

Not Applicable.

FIELD OF THE INVENTION

This invention relates to ladder stabilization support assemblies that provide lateral stabilization support to extension ladders preventing these ladders from tipping, overturning or slipping off the supporting grounds thereby significantly improving overall ladder stability and safety as well as considerably reducing the risk of related injuries.

BACKGROUND OF THE INVENTION

One of the most common problems with ladders in general and long span extension ladders in particular is the lack of sufficient lateral and vertical stability. When people climb high elevations on these ladders, such as second or third story building elevations, they may feel extremely uncomfortable and unsafe due to excessive lateral movements such as wiggling, wobbling or swaying from one side to the other. Tall and long span extension ladders, when fully extended, also tend to deflect under vertical loads, such as climber's weight and weight of tools and materials that may be carried with him, resulting in additional bouncing up or down movements, shaking or vibrating. Many people simply refuse to climb these ladders as even small lateral or vertical movements can cause a sense of apprehension often experienced by a climber at high elevations.

There is quite a number of inventions disclosed in the prior art that attempt to address ladder stabilization problems but most of them fall short in providing most effective, stable and safe solutions. Many of the inventions describe stabilization supports that are attached at a lower end of a ladder, closer to the ladder base, which contributes very little to improving lateral and vertical stability of long span extension ladders (as disclosed in U.S. Pat. Nos. 5,423,397; 6,167,989; 6,672,427; and 9,033,104). Some of these support assemblies seem to be overdone by having unnecessary over-complicated heavy-duty devices, such as complicated pivotal or ratchet adjustment mechanisms, adding on extra weight and cost to fabricate (as can be seen in U.S. Pat. Nos. 4,723,629 and 4,949,809). Many are very limited and time consuming to adjust especially where pins and aperture arrangements are used for length adjustments (as illustrated in U.S. Pat. Nos. 5,868,222; 6,533,071; 7,163,084; 9,187,954; and 9,482,053). Some tend to be cumbersome and awkward in design, difficult to operate and require special tools to setup.

There is a continuing need and desire in the industry to fill in the above gaps by providing a ladder stabilization support assembly capable to significantly improve lateral and vertical stability of long span extension ladders and at the same time to be designed as simple and user friendly as possible, versatile and easy to operate with tools-free quick and easy setup, easy to install and easy to adjust with nearly unlimited number of adjustment positions as well as to be lightweight and inexpensive to produce.

BRIEF SUMMARY OF THE INVENTION

It is a primary object of the present invention to provide a ladder stabilization support assembly capable to significantly improve lateral and vertical stability of ladders in general and long span extension ladders in particular thereby preventing these ladders from lateral movement such as lateral swaying, tipping or overturning as well as preventing the base of the ladders from slipping off the supporting grounds.

It is another object of the present invention to design the ladder stabilization support assembly to be as simple and user friendly as possible, versatile and easy to operate with tools-free setup, easy to install and easy to adjust with endless number of adjustment positions as well as to be lightweight and inexpensive to produce.

It is yet another object of the present invention to provide the ladder stabilization support assembly that can quickly and easily be mounted on or dismounted off a ladder, folded along the ladder sides or unfolded for free operation, remain permanently attached to the ladder or be completely taken off the ladder for storage when not in use.

It is a further object of the present invention to provide the ladder stabilization support assembly that when in a folded position can function as an adjustable ladder leg leveling stabilizer to properly level the ladder sides on any uneven ground or supporting surfaces such as stairs.

It is still a further object of the present invention to provide the ladder stabilization support assembly that allows an extension ladder which normally leans against a stable vertical support structure when in use to also operate in a self-supporting stand-alone mode.

The present invention is a ladder stabilization support assembly designed to provide lateral and vertical stabilization support to ladders in general and long span extension ladders in particular. The assembly is built to take advantage of a t-slotted aluminum profile to effectively support and level the ladders on any uneven supporting grounds with nearly unlimited number of adjustment positions.

The ladder stabilization support assembly comprising two telescopic support legs pivotally mounted on opposite sides of a ladder. Each telescopic support leg further comprising: a square tube profile member; a t-slot profile member made of a t-slotted aluminum profile which telescopically slides inside the square tube profile member; an adjustable sliding mechanism; a pivot joint; an upper mounting bracket; a lower mounting bracket; a swivel leveling foot; and an additional safety pin.

The adjustable sliding mechanism provides for a smooth, low tolerance and wobble-free telescopic sliding action with numerous length adjustment positions and adjusts automatically when the t-slot profile member is released to slide down to engage with the supporting ground. The pivot joint attached to an upper end of the square tube profile member allows to pivot the telescopic support leg by swinging it in or out in lateral direction as well as to rotationally swivel the telescopic support leg by moving it forward or backwards with endless number of pivotal and swivel adjustment positions. The rotational swivel movement of the telescopic support leg is limited to a maximum of 30 degrees to enable the recommended ladder pitch angle between the ladder and the ground of 75 degrees.

The telescopic support leg can quickly and easily be mounted or dismounted on or off a ladder side rail by means of upper and lower mounting brackets whereby eliminating the need for mounting apertures which otherwise could weaken the ladder. The telescopic support leg can quickly and easily be folded along the ladder side rail or unfolded for free pivotal and swivel operation, remain permanently attached to the ladder or be completely taken off the ladder for storage when not in use. With the telescopic support leg staying securely attached to the ladder side rail in a folded position, the lower mounting bracket allows the telescopic support leg to function as an adjustable leg leveling stabilizer to level the ladder side rails on any uneven supporting grounds. The swivel leveling foot with an anti-skid foot base attached at the bottom of the t-slot profile member provides for an effective friction resistant supporting base which automatically adjusts to any uneven ground contours. The ladder stabilization support assembly also allows extension ladders which normally lean against stable vertical support structures when in use to operate in the self-supporting stand-alone mode with the use of additional safety pins.

While the stabilization support assembly is primarily intended for use with long span extension ladders it can also be dimensioned for use with regular smaller in size step ladders.

All the features and advantages of the present invention should be better understood from the followed detailed description reviewed in conjunction with accompanying drawings.

DETAILED DESCRIPTION OF THE INVENTION

Figure 1:
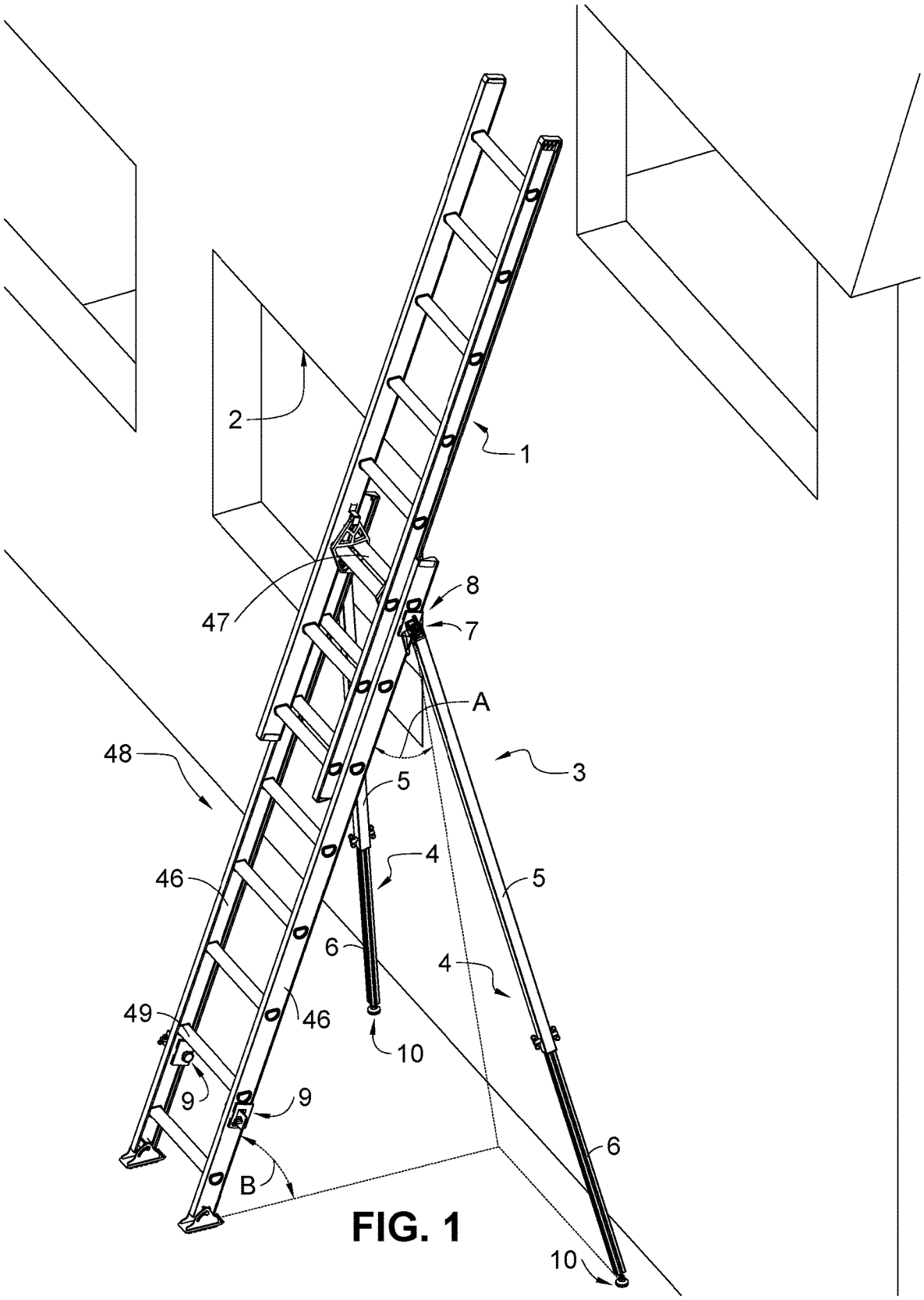
FIG. 1 is a prospective view of a ladder stabilization support assembly mounted on an extension ladder and set to operate with the ladder leaned against a vertical support structure.

A ladder stabilization support assembly designed to provide lateral and vertical stabilization support to ladders in general and long span extension ladders 1 in particular such as multi-sectional extension ladders that lean against stable vertical support structures 2 when in use and span from six feet when fully retracted all the way up to forty feet when fully extended.

The ladder stabilization support assembly 3 comprising two identical telescopic support legs 4 pivotally mounted on opposite sides of a ladder 1 with each telescopic support leg 4 built to telescopically extend or retract by taking an advantage of a light-weight t-slotted aluminum profile and to provide an ability to effectively support and level the ladder on any uneven supporting grounds.

Each telescopic support leg 4 further comprising: a square tube profile member 5; a t-slot profile member 6 made of a t-slotted aluminum profile which telescopically slides inside the square tube profile member 5; an adjustable sliding mechanism; an upper end plug 21; a pivot joint 7; an upper mounting bracket 8; a lower mounting bracket 9; a swivel leveling foot 10; and an additional safety pin 68.

Figure 7:
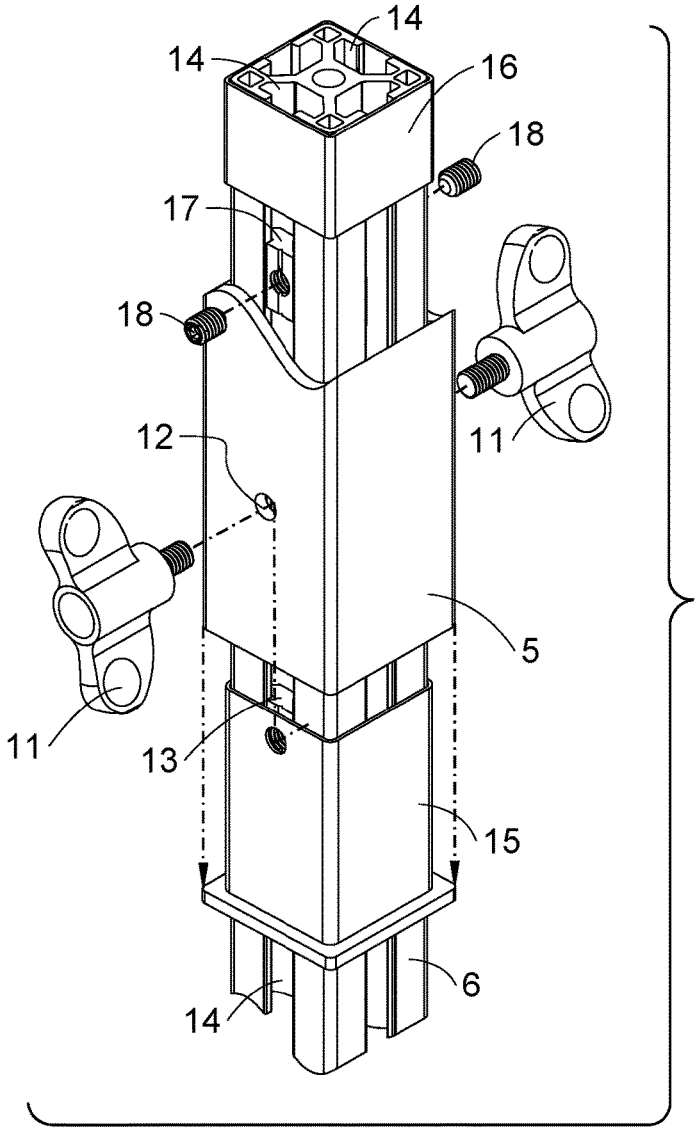
FIG. 7 is an exploded view of the individual components of a middle section of the telescopic support leg.

As the t-slot profile member 6 telescopically slides inside the square tube profile member 5 (FIG. 7), the sliding action is quickly and easily controlled, locked in specific positions or unlocked to resume continues sliding, by means of convenient and user-friendly wing knob fasteners 11 protruded through connecting apertures 12 in a lower end of the square tube profile member 5 and in a molded plastic hollow plug 15 to couple with self-locking t-nuts 13 placed inside t-tracks 14 of the t-slot profile member 6. When the wing knob fasteners 11 are released, the t-tracks 14 are free to travel along the self-locking t-nuts 13 which remain in their affixed positions. When the wing knob fasteners 11 are securely tightened, the t-tracks 14 are tightly clamped against the square tube profile member 5 by the self-locking t-nuts 13 terminating the sliding action and resulting in a strong shear and friction resistant connection joint capable of withstanding heavy weight loads. The molded plastic hollow plug 15 inserted into the lower end of the square tube profile member 5 and a molded plastic bushing 16 wrapped around an upper end of the t-slot profile member 6, both made of a smooth and dense plastic material, provide for a smooth, low tolerance, snug and wobble-free telescopic sliding action.

Figure 3:
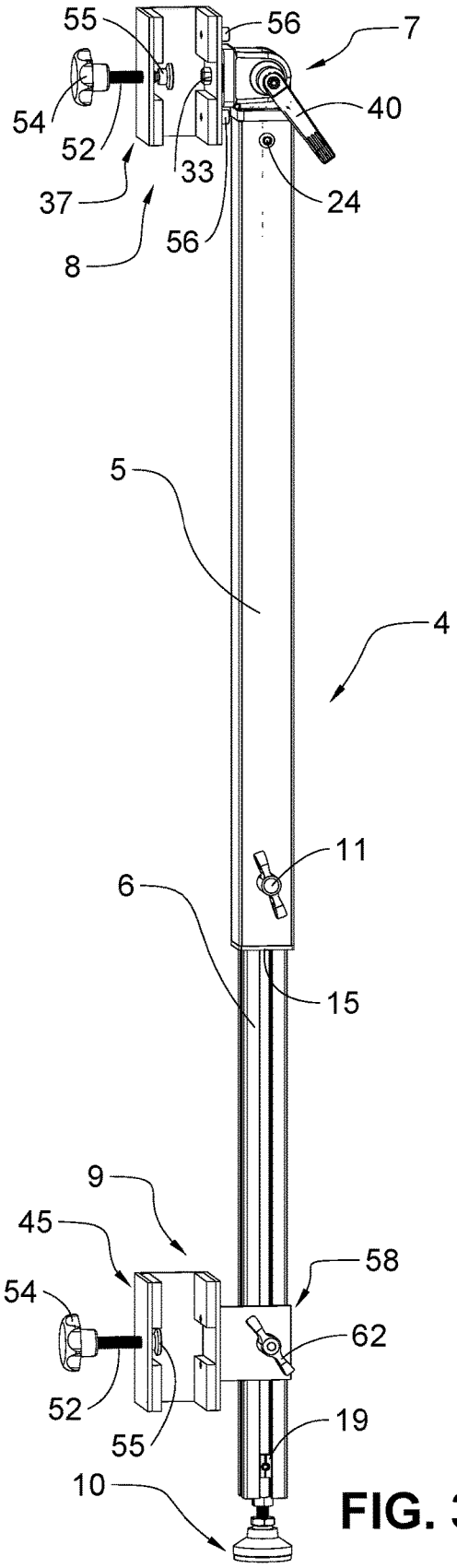
FIG. 3 is a prospective view of fully assembled telescopic support leg.
Figure 4:
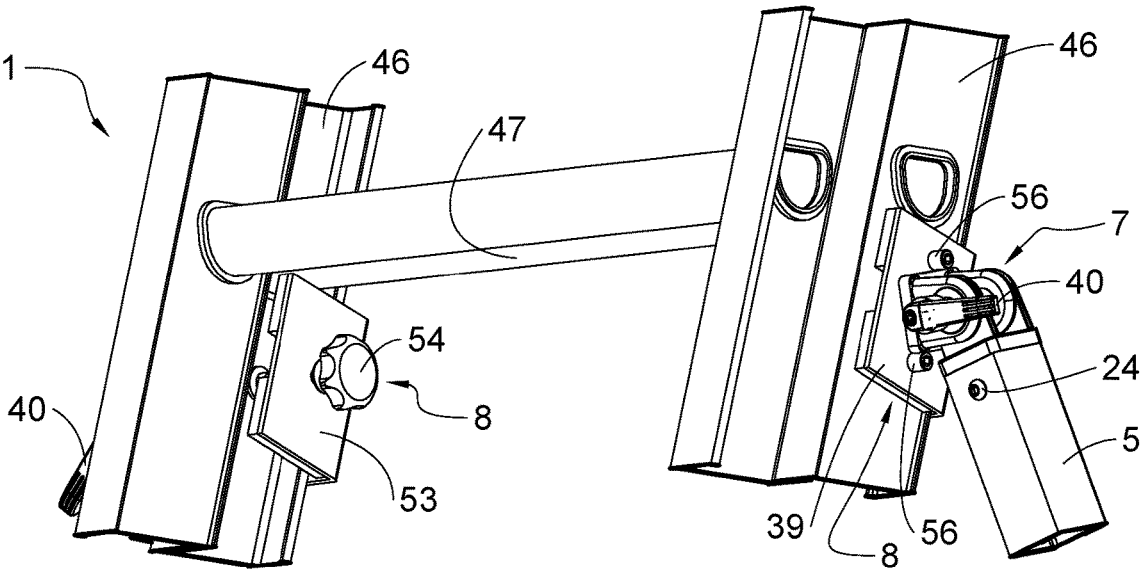
FIG. 4 is a prospective view of a top section of the telescopic support leg mounted on the extension ladder.
Figure 5:
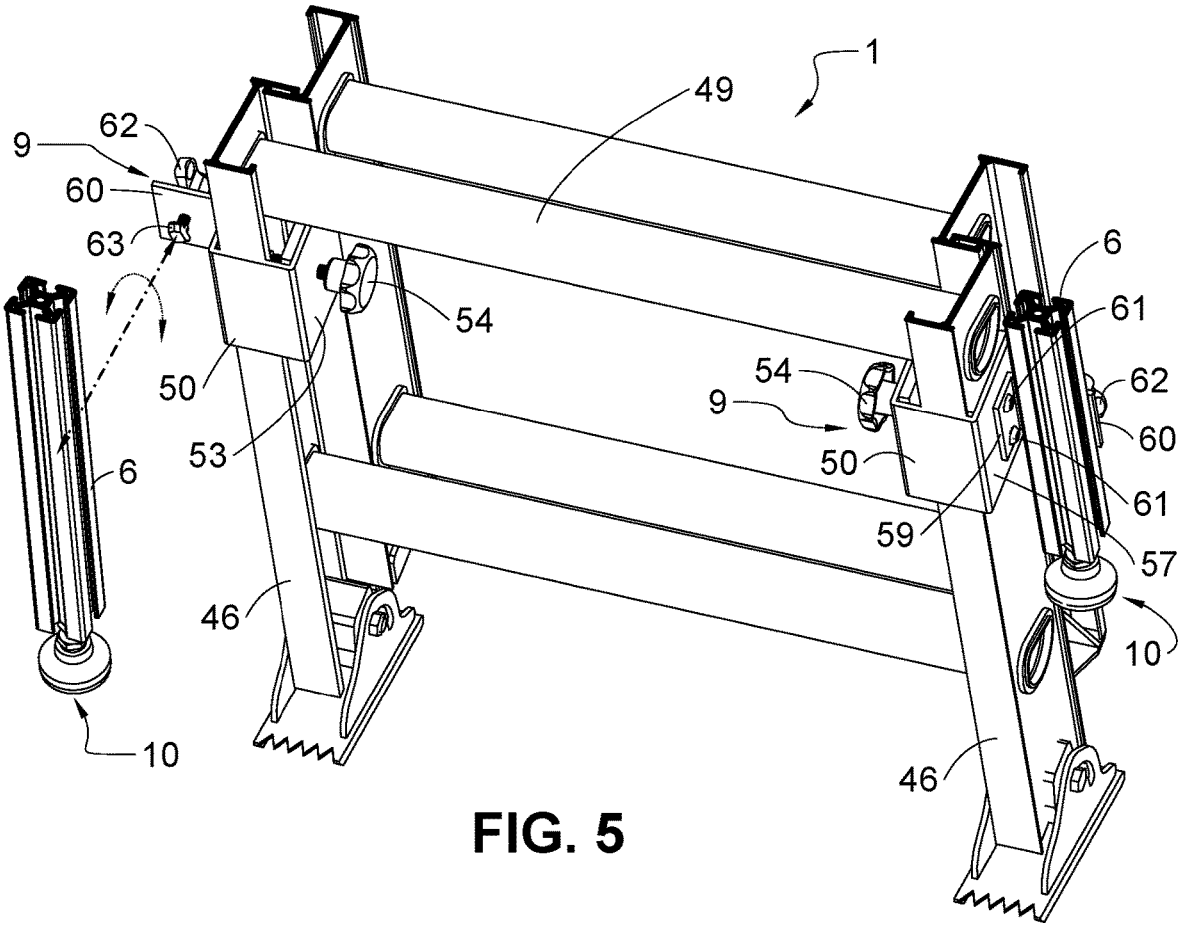
FIG. 5 is a prospective view of a bottom section of the telescopic support leg mounted on the extension ladder in the folded position on one side of the ladder and disengaged from the folded position on the other side of the ladder for free pivotal and swivel operation.
Figure 9:
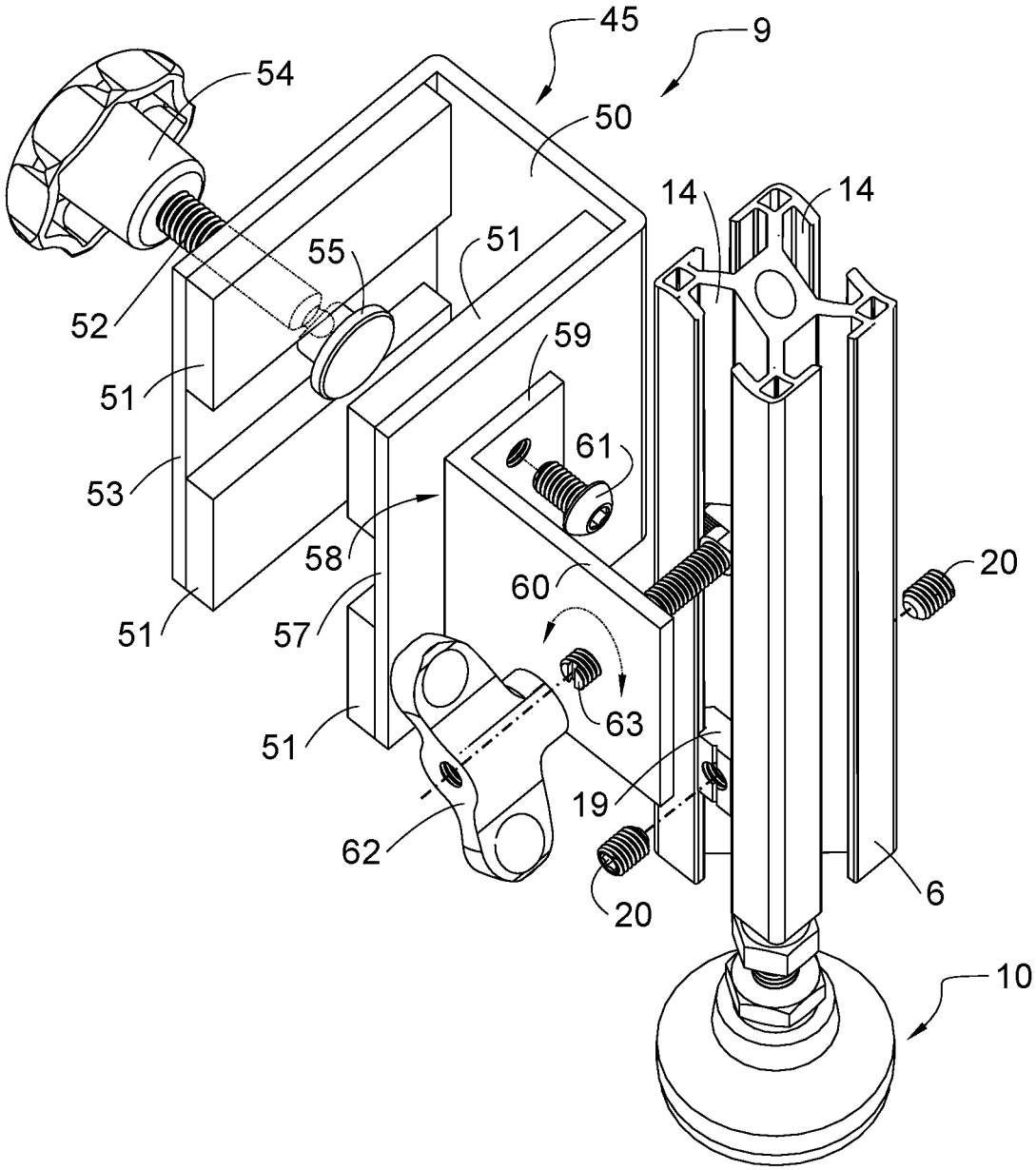
FIG. 9 is an exploded view of the individual components of the bottom section of the telescopic support leg.

Self-locking t-nuts 17 positioned inside the t-tracks 14 at the upper end of the t-slot profile member 6 right below the molded plastic bushing 16 and secured in place by suitable socket set fasteners 18 terminate the sliding action when the telescopic support leg 4 is fully extended thereby preventing the t-slot profile member 6 from completely sliding out of the square tube profile member 5. Self-locking t-nuts 19 (FIG. 3, FIG. 9) positioned inside the t-tracks 14 at a lower end of the t-slot profile member 6 and secured in place by suitable socket set fasteners 20 terminate the sliding action when the telescopic support leg 4 is fully retracted. The resulting adjustable sliding mechanism provides for numerous length adjustment positions and adjusts automatically when the t-slot profile member 6 is released to slide down under its own weight to engage with the supporting ground.

Figure 6:
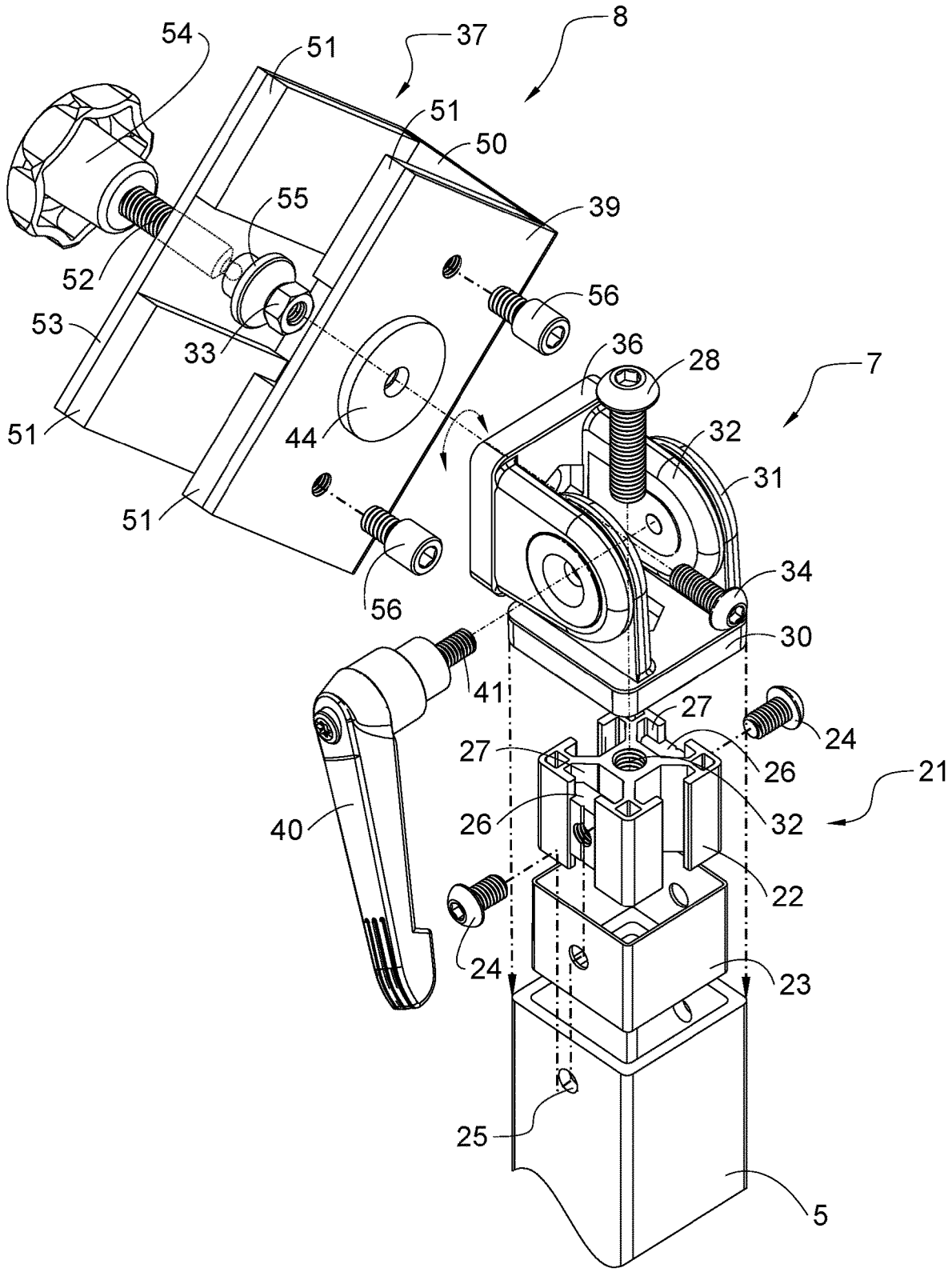
FIG. 6 is an exploded view of the individual components of the top section of the telescopic support leg.

The upper end plug 21 (FIG. 6) inserted into an upper end of the square tube profile member 5 provides for an attachment supporting base for the pivot joint 7. The upper end plug 21 comprising: a t-slot plug 22 made of the t-slotted aluminum profile; a molded plastic spacer 23 wrapped around the t-slot plug 22; and suitable socket button head fasteners 24 protruded through connecting apertures 25 in the upper end of the square tube profile member 5 and in the molded plastic spacer 23 to couple with self-locking t-nuts 26 placed inside t-tracks 27 of the t-slot plug 22 to securely attach the upper end plug 21 to the square tube profile member 5.

The pivot joint 7 (FIG. 6) provides for a pivotal movement of the telescopic support leg 4 when it is swung in or out in lateral direction with endless number of pivotal adjustment positions and provides for a swivel movement of the telescopic support leg 4 when it is moved forward or backwards. The pivot joint 7 comprising: two identical halves 31, 32 pivotally connected to each other; a suitable fastener 28 protruded through a connecting aperture in a bottom section 30 of one half 31 and threaded into a pre-tapped cylindrical channel 32 of the t-slot plug 22 to securely attach the pivot joint 7 to the upper end plug 21; a suitable lock nut 33 coupled with a suitable fastener 34 protruded through connecting apertures in a bottom section 36 of the other half 32, in a nylon spacer 44 and in an opposite sidewall section 39 of a u-shaped clamping channel 37 to rotationally attach the pivot joint 7 to the u-shaped clamping channel 37; a convenient and user-friendly adjustable lever handle 40 secured to a threaded stud 41; and the threaded stud 41 protruded through connecting apertures in both halves 31, 32 and threaded into a pre-tapped aperture in one half 31 to allow both halves 31, 32 to pivot against each other variating an adjustable pivotal angle to a maximum of 180 degrees or to allow both halves 31, 32 to be tightly clamped against each other in specific pivotal angle adjustment positions, such that the adjustable lever handle 40 controls the pivotal movement of the telescopic support leg 4 by securely locking the telescopic support leg 4 in specific pivotal adjustment positions or releasing the telescopic support leg 4 to resume free pivotal operation.

When the pivot joint 7 capable of withstanding heavy weight loads is tightly clamped by the adjustable lever handle 40, the telescopic support leg 4 is securely locked in place and reliably prevented from any lateral movement (such as from overturning laterally) so that when the ladder 1 is not operated in a self-supporting stand-alone mode there should be no need for any additional safety means (such as additional safety pins, bracing arms or tying straps) to further safeguard the lateral movement of the telescopic support leg.

Figure 2:
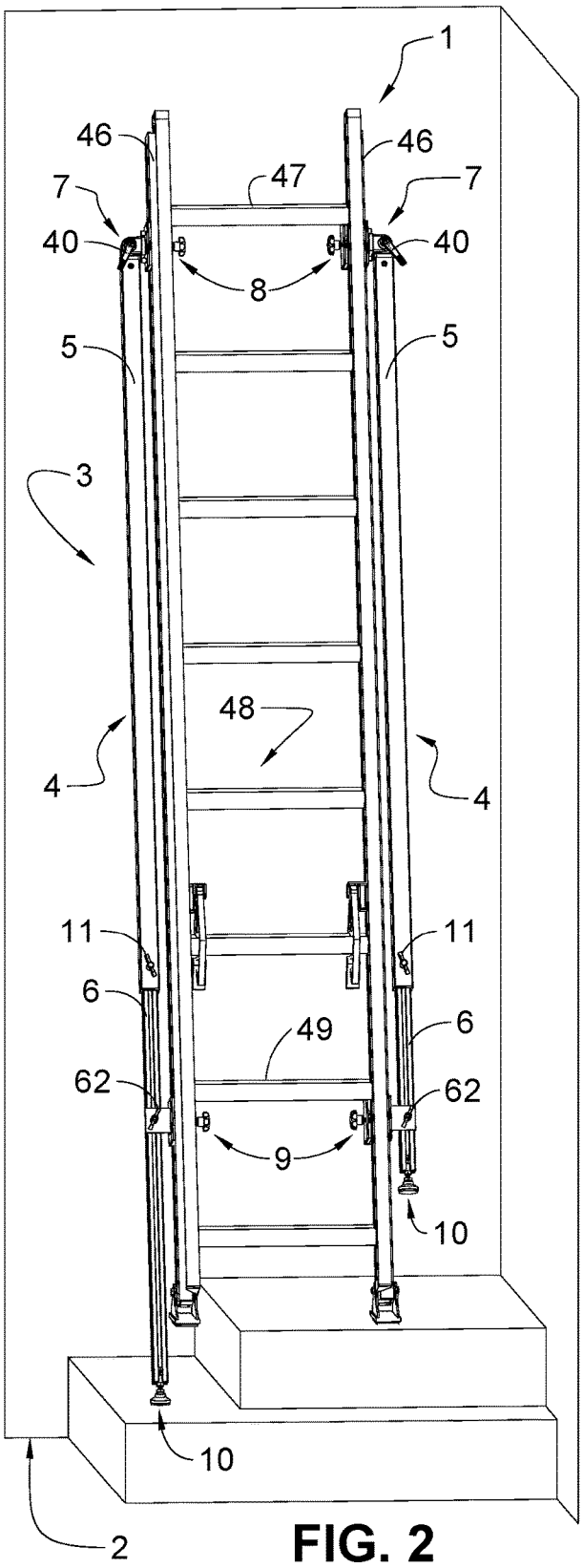
FIG. 2 is a prospective view of the ladder stabilization support assembly mounted on the extension ladder and set into a folded position to level the ladder side rails on uneven floor steps.

The telescopic support leg 4 can quickly and easily be mounted on or dismounted off a ladder side rail 46 (FIG. 1, FIG. 2, FIG. 4, FIG. 5, FIG. 10) by means of upper and lower mounting brackets 8, 9 whereby eliminating the need for connecting apertures which otherwise could weaken the ladder 1. The upper mounting bracket 8 mounts or dismounts an upper end of the telescopic support leg 4 on or off the ladder side rail 46 at a most appropriate position being right underneath an uppermost rung 47 (FIG. 1, FIG. 2, FIG. 4, FIG. 10) of a ladder base section 48 (FIG. 1, FIG. 2, FIG. 10) and securely clamps the upper end of the telescopic support leg 4 to the ladder side rail 46. The lower mounting bracket 9 mounts or dismounts a lower end of the telescopic support leg 4 on or off the ladder side rail 46 at a most appropriate position being right underneath a second rung 49 (FIG. 1, FIG. 2, FIG. 5, FIG. 10) from a bottom of the ladder base section 48 and securely clamps the lower end of the telescopic support leg 4 to the ladder side rail 46 in a folded position parallel to the ladder side rail 46.

The upper mounting bracket 8 (FIG. 6) comprising: the u-shaped clamping channel 37 having a base section 50 and two identical side wall sections 39, 53 parallel to each other and perpendicular to the base section 50; smooth and rigid plastic spacers 51 affixed to the inner surface of each side wall section 39, 53 to smooth out or flatten any possible protrusions on an outer surface of the ladder side rail 46; a clamping ball stud 52 threaded into a pre-tapped aperture in one side wall section 53; a convenient and user-friendly wing knob clamping handle 54 secured to the clamping ball stud 52 at one end; a clamping base foot 55 pivotally attached to the clamping ball stud 52 at the other ball end; the nylon spacer 44 affixed to the opposite side wall section 39 for tied and smooth rotation of the pivot joint 7 against the u-shaped clamping channel 37; and two socket cap screws 56 fastened into pre-tapped apertures in the opposite side wall section 39 at designated positions to serve as stop bumpers to limit the rotation angle A (FIG. 1, FIG. 10) of the pivot joint 7 to a maximum of 30 degrees and to enable the recommended ladder pitch angle B (FIG. 1, FIG. 10) between the ladder 1 and the supporting ground of 75 degrees.

The lower mounting bracket 9 (FIG. 9) comprising: a u-shaped clamping channel 45, the plastic spacers 51, the clamping ball stud 52, the wing knob clamping handle 54 and the clamping base foot 55—are all the same components as in the upper mounting bracket 8 with the exception of an opposite side wall section 57 of the u-shaped clamping channel 45 configured to have only pre-tapped apertures for connecting to an I-shaped supporting bracket 58; the I-shaped supporting bracket 58 having two identical leg sections 59, 60 perpendicular to each other; suitable socket button head fasteners 61 protruded through connecting apertures in one leg section 59 and threaded into the pre-tapped apertures in the opposite side wall section 57 to securely attach the I-shaped supporting bracket 58 to the u-shaped clamping channel 45; a drop-in t-stud 63 protruded through a connecting aperture in the other leg section 60; and a convenient and user-friendly wing knob locking handle 62 threaded onto the drop-in t-stud 63 to allow to quickly place the drop-in t-stud 63 into a locking position inside the t-track 14 of the t-slot profile member 6 by turning the drop-in t-stud 63 clockwise and to allow to tightly clamp the t-track 14 against the I-shaped supporting bracket 58 securing the telescopic support leg 4 in the folded position, or to allow to quickly disengage the telescopic support leg 4 from the folded position to resume free pivotal and swivel operation by releasing the wing knob locking handle 62 and turning the drop-in t-stud 63 counterclockwise.

The lower mounting bracket 9 also allows the telescopic support leg 4 to function as an adjustable leg leveling stabilizer to level the ladder side rails 46 on any uneven supporting grounds while the telescopic support leg 4 stays securely attached to the I-shaped supporting bracket 58 in the folded position, such that when the wing knob locking handle 62 is released the t-track 14 of the t-slot profile member 6 slides along the drop-in t-stud 63 as the telescopic support leg 4 telescopically extends or retracts and the wing knob locking handle 62 controls the sliding action by either securely clamping the t-slot profile member 6 against the I-shaped supporting bracket 58 in specific length adjustment positions or releasing the t-slot profile member 6 to slide down under its own weight to automatically adjust to any uneven supporting ground surfaces such as stairs.

Figure 8:
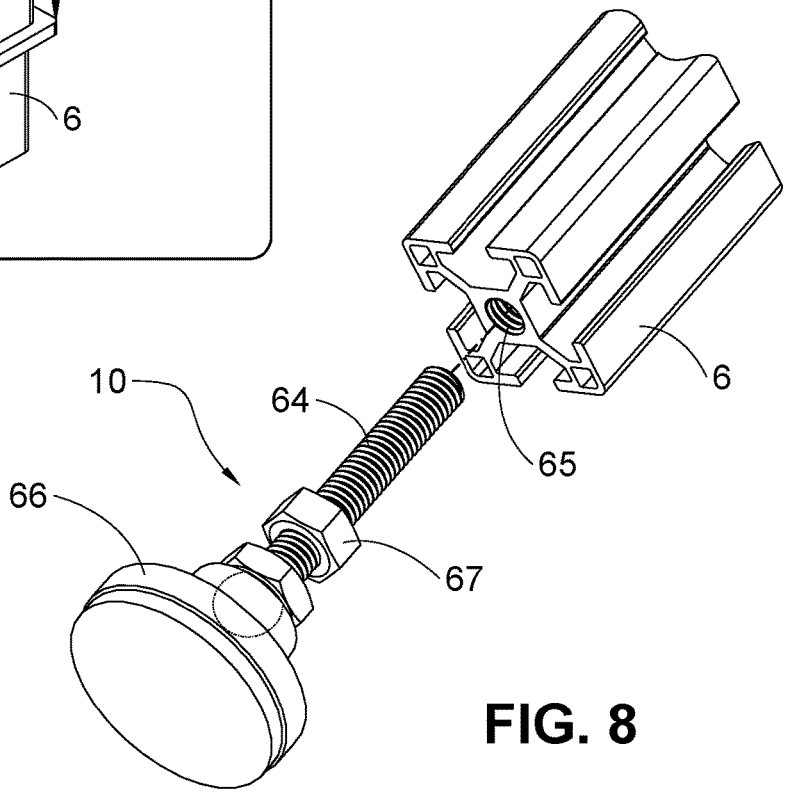
FIG. 8 is an exploded view of the individual components of a swivel leveling foot and the swivel leveling foot connection to a bottom end of the telescopic support leg.

The swivel leveling foot 10 (FIG. 8) provides for an effective friction resistant supporting base which automatically adjusts to any uneven ground contour. The swivel leveling foot 10 comprising: a swivel ball stud 64 at one end threaded into a pre-tapped cylindrical channel 65 in the bottom of the t-slot profile member 6 and at the other ball end pivotally attached to an anti-skid foot base 66; the anti-skid foot base 66; and a corresponding lock nut 67 to secure the swivel ball stud 64 to the t-slot profile member 6 at a designated length adjustment position.

Figure 10:
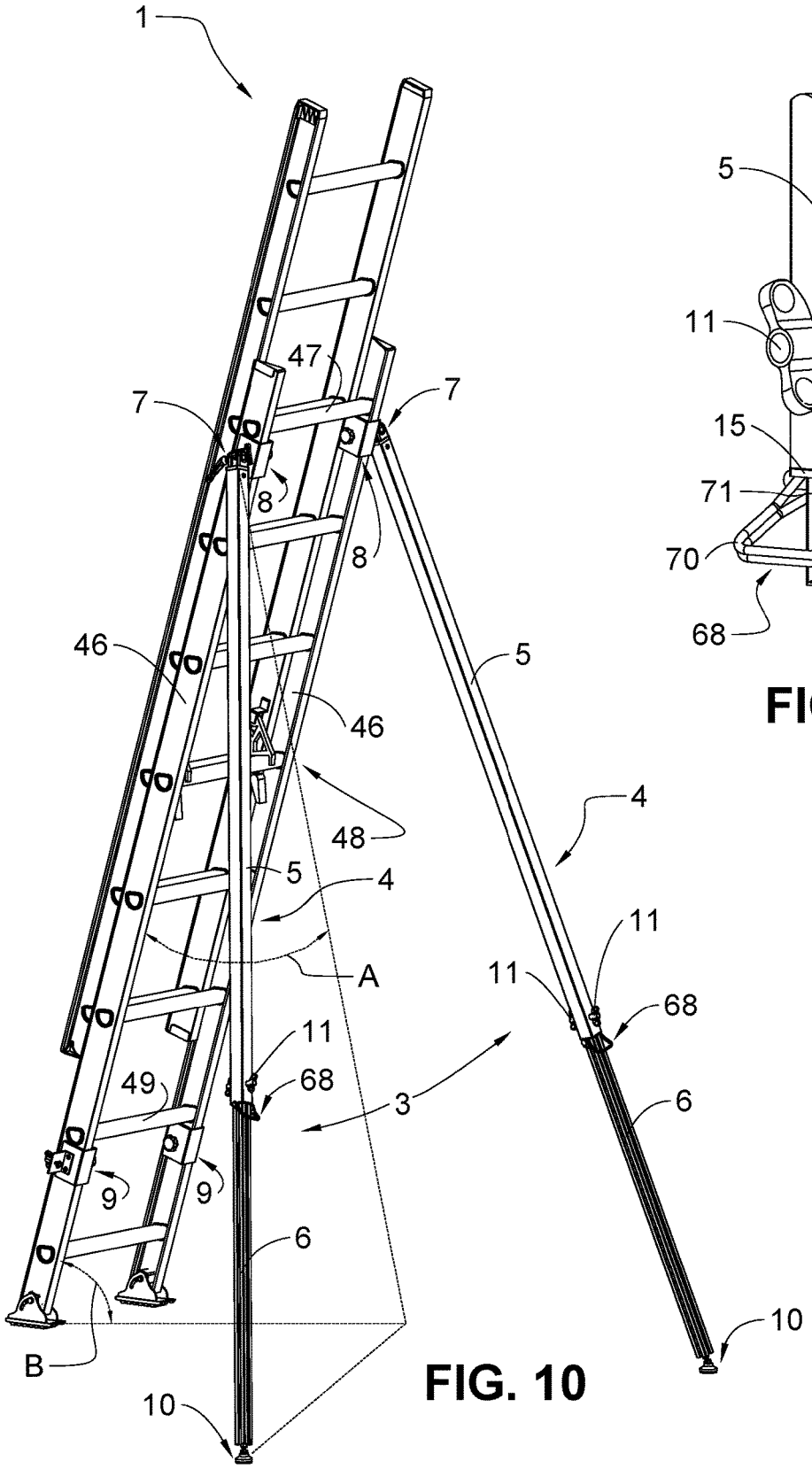
FIG. 10 is a prospective view of the ladder stabilization support assembly mounted on the extension ladder and set to operate with the ladder in a self-supporting stand-alone mode utilizing additional safety pins.
Figure 11:
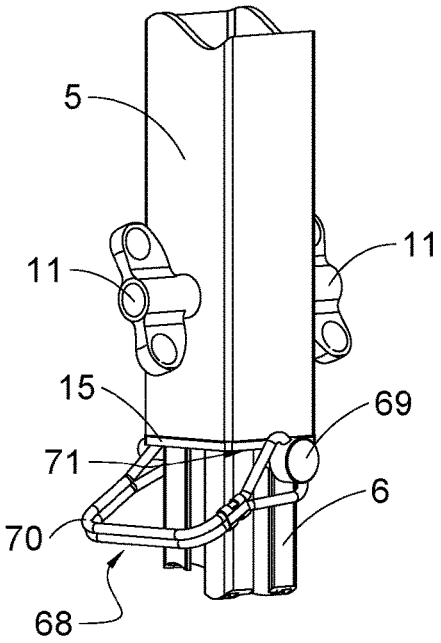
FIG. 11 is a prospective view of an additional safety pin used with the telescopic support leg when the ladder is operated in the self-supporting stand-alone mode.

The additional safety pin 68 (FIG. 10, FIG. 11) allows an extension ladder 1 that normally leans against a stable vertical support structure when in use to also operate in the self-supporting stand-alone mode with the telescopic support legs 4 set into most stable self-supporting locking positions on a relatively leveled supporting ground (as illustrated in FIG. 10). The additional safety pin 68 comprising: a suitable wire lock pin 69 (or a suitable self-locking pin) inserted into one of pre-arranged apertures in the t-slot profile member 6 to engage with the bottom edge 71 of the square tube profile member 5 and to enable the most shear resistant connection joint between the t-slot profile member 6 and the square tube profile member 5 capable of withstanding significant extra heavy weight loads; and a wire lock 70 (in case no self-locking pins are being used) to securely lock the wire lock pin 69 in the most stable self-supporting locking position of the telescopic support leg.

It is not limited to but preferred that all the specified structural components (including the t-slotted profile) be made of a lightest weight aluminum alloys and all the specified hardware (such as self-aligning/self-clocking t-nuts, drop-in t-studs, clamping studs, etc. as well as all other fasteners) be made of stainless steel.

The following is what is claimed:

1. A ladder stabilization support assembly designed to provide lateral and vertical stabilization support to ladders in general and long span extension ladders in particular such as multi-sectional extension ladders that lean against stable vertical support structures when in use and span from six feet when fully retracted all the way up to forty feet when fully extended, the ladder stabilization support assembly comprising:

two identical telescopic support legs pivotally mounted on opposite sides of a ladder, wherein each telescopic support leg is built to telescopically extend or retract by taking an advantage of a light-weight t-slotted aluminum profile and to provide an ability to effectively support and level the ladder on any uneven supporting grounds, and each telescopic support leg further comprising:

a square tube profile member;

a t-slot profile member made of a conventional t-slotted aluminum profile having t-tracks configured to accept conventional t-slot fasteners, wherein said t-slot profile member is fitted to telescopically slide inside the square tube profile member;

an upper end plug inserted into an upper end of the square tube profile member provides for an attachment supporting base for a pivot joint;

the pivot joint provides for a pivotal movement of the telescopic support leg when it is swung in or out in lateral direction with unlimited number of pivotal adjustment positions and provides for a swivel movement of the telescopic support leg when it is moved forward or backwards with unlimited number of swivel adjustment positions within a recommended range;

an upper mounting bracket to mount or dismount an upper end of the telescopic support leg on or off a ladder side rail and to securely clamp the upper end of the telescopic support leg to the ladder side rail;

a lower mounting bracket to mount or dismount a lower end of the telescopic support leg on or off the ladder side rail and to securely clamp the lower end of the telescopic support leg to the ladder side rail in a folded position parallel to the ladder side rail;

a swivel leveling foot to provide for an effective friction resistant supporting base which automatically adjusts to any uneven ground contour; and an adjustable sliding mechanism provides for numerous length adjustment positions and adjusts automatically when the t-slot profile member is released to slide down under its own weight to engage with the supporting ground, wherein the adjustable sliding mechanism further comprising:

a molded plastic hollow plug inserted into a lower end of the square tube profile member and a molded plastic bushing wrapped around an upper end of the t-slot profile member, both made of a smooth and dense plastic material, to provide for a smooth, low tolerance, snug and wobble-free telescopic sliding action;

convenient and user-friendly wing knob fasteners protruded through connecting apertures in the lower end of the square tube profile member and in the molded plastic hollow plug, and threaded into self-locking t-nuts placed inside the t-tracks of the t-slot profile member to control the telescopic sliding action by locking the t-tracks against the square tube profile member in specific length adjustment positions or releasing the t-tracks to resume continues sliding, wherein said self-locking t-nuts are configured to self-align within the t-tacks resulting in a smooth and unobstructed sliding of the t-tracks alongside of said self-locking t-nuts;

self-locking t-nuts positioned inside the t-tracks at the upper end of the t-slot profile member below the molded plastic bushing and locked in place by suitable socket set fasteners to terminate the sliding action when the telescopic support leg is fully extended preventing the t-slot profile member from completely sliding out of the square tube profile member; and self-locking t-nuts positioned inside the t-tracks at a lower end of the t-slot profile member and locked in place by suitable socket set fasteners to terminate the sliding action when the telescopic support leg is fully retracted, such that when said self-locking t-nuts are unlocked they can be slidably moved along the t-tracks of the t-slot profile member and be re-locked in any desired position to adjust a range of sliding by either increasing or decreasing the maximum length by which the t-slot profile member can retract or extend.

2. The ladder stabilization support assembly of claim 1, wherein the upper end plug further comprising:

a t-slot plug made of the t-slotted aluminum profile;

a molded plastic spacer wrapped around the t-slot plug; and button head fasteners protruded through connecting apertures in the upper end of the square tube profile member and in the molded plastic spacer to couple with self-locking t-nuts placed inside t-tracks of the t-slot plug to securely attach the upper end plug to the square tube profile member.

3. The ladder stabilization support assembly of claim 1, wherein the pivot joint further comprising:

two identical halves pivotally connected to each other;

a suitable fastener protruded through a connecting aperture in a bottom section of one half and threaded into a pre-tapped aperture in the upper end plug to securely attach the pivot joint to the upper end plug;

a suitable lock nut coupled with a suitable fastener protruded through connecting apertures in a bottom section of the other half, in a nylon spacer and in the upper mounting bracket to securely attach the pivot joint to the upper mounting bracket allowing the pivot joint to rotationally swivel against the upper mounting bracket during a swivel operation of the telescopic support leg;

a convenient and user-friendly adjustable lever handle secured to a threaded stud; and the threaded stud protruded through connecting apertures in both halves and threaded into a pre-tapped aperture in one half to allow both halves to pivot against each other variating an adjustable pivotal angle to a maximum of 180 degrees or to allow both halves to be tightly clamped against each other in specific pivotal angle adjustment positions, such that the adjustable lever handle controls the pivotal movement of the telescopic support leg by securely locking the telescopic support leg in specific pivotal adjustment positions or releasing the telescopic support leg to resume free pivotal operation.

4. The ladder stabilization support assembly of claim 1, wherein the upper mounting bracket further comprising:

a u-shaped clamping channel having a base section and two identical side wall sections parallel to each other and perpendicular to the base section;

smooth and rigid plastic spacers affixed to the inner surface of each side wall section to smooth out or flatten any possible protrusions on an outer surface of the ladder side rail;

a clamping ball stud threaded into a pre-tapped aperture in one side wall section;

a convenient and user-friendly wing knob clamping handle secured to the clamping ball stud at one end;

a clamping base foot pivotally attached to the clamping ball stud at the other ball end;

a nylon spacer affixed between the opposite side wall section of the u-shaped clamping channel and the pivot joint to smooth out a rotational swivel movement of the pivot joint against the upper mounting bracket during a swivel operation of the telescopic support leg; and two socket cap fasteners threaded into pre-tapped apertures in the opposite side wall section of the u-shaped clamping channel at designated positions to serve as stop bumpers to limit the rotational swivel movement of the pivot joint to a maximum of 30 degrees and to enable the recommended ladder pitch angle between the ladder and the supporting ground of 75 degrees.

5. The ladder stabilization support assembly of claim 1, wherein the lower mounting bracket further comprising:

a u-shaped clamping channel having a base section and two identical side wall sections parallel to each other and perpendicular to the base section;

smooth and rigid plastic spacers affixed to the inner surface of each side wall section to smooth out or flatten any possible protrusions on an outer surface of the ladder side rail;

a clamping ball stud threaded into a pre-tapped aperture in one side wall section;

a convenient and user-friendly wing knob clamping handle secured to the clamping ball stud at one end;

a clamping base foot pivotally attached to the clamping ball stud at the other ball end;

an L-shaped supporting bracket having two identical leg sections perpendicular to each other;

button head fasteners protruded through connecting apertures in one leg section and threaded into pre-tapped apertures in the other side wall section of said u-shaped clamping channel to securely attach the L-shaped supporting bracket to said u-shaped clamping channel;

a drop-in t-stud having a head section with an elliptical shoulder protrusion and a threaded stud section protruded through a connecting aperture in the other leg section of the L-shaped supporting bracket, such that when the head section is inserted into a t-track of the t-slot profile member the elliptical shoulder protrusion allows to place the drop-in t-stud, with a 90° turn, into a self-locking position properly aligned within the t-track for a smooth and unobstructed sliding of the t-track alongside of the drop-in t-stud; and a convenient and user-friendly wing knob locking handle threaded onto the drop-in t-stud to quickly place the drop-in t-stud into the self-locking position inside the t-track of the t-slot profile member by turning the drop-in t-stud clockwise and to tightly clamp the t-track against the L-shaped supporting bracket securing the telescopic support leg in the folded position, or to quickly disengage the telescopic support leg from the L-shaped supporting bracket to resume free pivotal and swivel operation by releasing the wing knob locking handle and turning the drop-in t-stud counterclockwise.

6. The ladder stabilization support assembly of claim 5, wherein the lower mounting bracket further allows the telescopic support leg to function as an adjustable leg leveling stabilizer to level the ladder side rails on any uneven supporting grounds while the telescopic support leg stays securely attached to the lower mounting bracket in the folded position, such that when the wing knob locking handle is released the t-track of the t-slot profile member slides alongside of the drop-in t-stud as the telescopic support leg telescopically extends or retracts and the wing knob locking handle controls the sliding action by either securely clamping the t-slot profile member against the L-shaped supporting bracket in specific length adjustment positions or releasing the t-slot profile member to slide down under its own weight to automatically adjust to any uneven supporting ground surfaces.

* * * * *